US009326341B2

(12) United States Patent
Lin et al.

(10) Patent No.: US 9,326,341 B2
(45) Date of Patent: Apr. 26, 2016

(54) LIGHT-EMITTING MODULE, LED DRIVING CIRCUIT, AND LED DRIVING METHOD

(71) Applicant: LEXTAR ELECTRONICS CORPORATION, Hsinchu (TW)

(72) Inventors: Liang-Ta Lin, Guishan Township (TW); Lei-Hsing Liu, Hsinchu (TW)

(73) Assignee: LEXTAR ELECTRONICS CORPORATION, Hsinchu (TW)

( * ) Notice: Subject to any disclaimer, the term of this patent is extended or adjusted under 35 U.S.C. 154(b) by 172 days.

(21) Appl. No.: 13/975,663

(22) Filed: Aug. 26, 2013

(65) Prior Publication Data

US 2014/0103830 A1 Apr. 17, 2014

(30) Foreign Application Priority Data

Oct. 12, 2012 (TW) ..... 101137753 A

(51) Int. Cl.
*H05B 37/02* (2006.01)
*H05B 33/08* (2006.01)

(52) U.S. Cl.
CPC ..... *H05B 33/0839* (2013.01); *H05B 33/0845* (2013.01); *H05B 33/0818* (2013.01)

(58) Field of Classification Search
None
See application file for complete search history.

(56) References Cited

U.S. PATENT DOCUMENTS

| | | | | |
|---|---|---|---|---|
| 2007/0115662 | A1* | 5/2007 | Roberts et al. | 362/252 |
| 2009/0174343 | A1* | 7/2009 | Lenz et al. | 315/292 |
| 2009/0189548 | A1* | 7/2009 | Hoffman et al. | 315/307 |
| 2010/0237799 | A1* | 9/2010 | Choi et al. | 315/294 |
| 2011/0012530 | A1* | 1/2011 | Zheng et al. | 315/294 |
| 2011/0134155 | A1* | 6/2011 | Woo et al. | 345/690 |
| 2011/0156604 | A1* | 6/2011 | Kuo et al. | 315/185 R |
| 2012/0146533 | A1* | 6/2012 | Park | 315/224 |

FOREIGN PATENT DOCUMENTS

| | | | |
|---|---|---|---|
| CN | 100525575 | C | 8/2009 |
| CN | 201805593 | U | 4/2011 |
| TW | 201026144 | A | 7/2010 |
| TW | I355636 | | 1/2012 |
| TW | M423976 | U | 3/2012 |

* cited by examiner

*Primary Examiner* — Cassandra Cox
(74) *Attorney, Agent, or Firm* — Moser Taboada

(57) ABSTRACT

A light-emitting diode (LED) driving circuit is configured for driving at least one group of LEDs. The LED driving circuit includes a constant current source, a pulse width modulation (PWM) element, and at least one pulse frequency modulation (PFM) element. The constant current source is configured for generating a current signal with a constant current value; the PWM element is electrically connected to the constant current source and configured for modulating the current signal to generate a PWM signal corresponding to the current signal; the PFM element is electrically connected between the PWM element and the LED and configured for modulating a frequency width of the PWM signal to generate at least one PFM signal for driving the LED.

10 Claims, 9 Drawing Sheets

LIGHT-EMITTING MODULE, LED DRIVING CIRCUIT, AND LED DRIVING METHOD

RELATED APPLICATIONS

This application claims priority to Taiwan Patent Application Serial Number 101137753, filed Oct. 12, 2012, which is herein incorporated by reference.

BACKGROUND

1. Field of Invention

The invention relates to a driving circuit and method. More particularly, the invention relates to a light-emitting diode (LED) driving circuit and method.

2. Description of Related Art

Recently, LED-related techniques are developed rapidly, and light-emitting techniques thereof have been widely used in the fields of lighting, backlight source and the like. As having many advantages, such as a thin and small size, power saving characteristic, long lifetime and excellent color saturation, the LED has become the most developmental light-emitting source.

A pulse width modulation (PWM) mode is used for modulating light-emitting intensity of the LED. Since the PWM mode changes pulse widths of different LEDs, the different LEDs have different total light-emitting power. After long-time use of the LEDs, differences may occur in brightness decay situations thereof, which cause color dot deviation and picture distortion or color temperature imbalance.

Therefore, it is necessary to improve the LED driving circuit for reducing the color temperature imbalance.

SUMMARY

An aspect of the invention provides a LED driving circuit, which uses a pulse frequency modulation (PFM) mode to modulate light-emitting intensity of a LED.

An employment of the invention relates to a LED driving circuit, which is configured for driving at least one group of LEDs. The LED driving circuit includes a constant current source, a pulse width modulation (PWM) element, and at least one PFM element. The constant current source is configured for generating a current signal with a constant current value; the PWM element is electrically connected to the constant current source and configured for modulating the current signal to generate a PWM signal corresponding to the current signal; the PFM element is electrically connected between the PWM element and the LED and configured for modulating a frequency width of the PWM signal to generate at least one PFM signal for driving the LED.

Another embodiment of the invention relates to a LED driving circuit, in which the above-described PWM signal includes a plurality of pulses identical in width.

A further embodiment of the invention relates to a LED driving circuit, in which at least one PFM signal described above includes a plurality of pulses identical in width, and at least two of time intervals among the pulses are different.

Still a further embodiment of the invention relates to a LED driving circuit, in which when at least one PFM element modulates a frequency width of the PWM signal, the above-described PFM signal is changed and a light-emitting frequency of the above-described LED is also changed.

Yet a further embodiment of the invention relates to a LED driving circuit, which further includes a voltage regulator circuit connected in parallel with the LED.

Another aspect of the invention provides a light-emitting module, which includes plural groups of LEDs that are connected in parallel with each other and a driving circuit. The driving circuit is configured for driving the above-described LEDs, including a constant current source, a PWM element, and a plurality of PFM elements. The constant current source is configured for generating a current signal with a constant current value; the PWM element is electrically connected to the constant current source and configured for modulating the current signal to generate a PWM signal corresponding to the current signal; and the plurality of PFM elements are each electrically connected between the LEDs and the PWM element and configured for modulating a frequency width of the PWM signal to generate a plurality of PFM signals for driving each of the LEDs.

An embodiment of the invention relates to a light-emitting module, in which the above-described PWM signal includes a plurality of pulses identical in width.

Another embodiment of the invention relates to a light-emitting module, in which each of the above-described PFM signals includes a plurality of pulses identical in width, and at least two of time intervals among the pulses are different.

A further embodiment of the invention relates to a light-emitting module, in which when the above-described PFM element modulates a frequency width of the PWM signal, the PFM signals are each changed, and light-emitting frequencies of the LEDs are also each changed.

Still a further embodiment of the invention relates to a light-emitting module, which further includes a voltage regulator circuit connected in parallel with the LED.

A further aspect of the invention provides a method for driving a LED, which includes the following steps: modulating a current signal with a constant current value into a PWM signal; and modulating the PWM signal into at least one PFM signal for driving at least one group of LEDs.

An embodiment of the invention relates to the method for driving the LED, in which the step of modulating the current signal into the PWM signal further includes: modulating the current signal into a plurality of pulses as the PWM signal, in which these pulses are identical in width.

Another embodiment of the invention relates to the method for driving the LED, in which the step of modulating the PWM signal into at least one PFM signal further includes: modulating time intervals among the pulses, such that at least two of the time intervals among these pulses are different.

A further embodiment of the invention relates to the method for driving the LED, in which when the time intervals among these pulses are modulated, light-emitting frequencies of at least one group of LEDs are changed.

DETAILED DESCRIPTION

The invention will be described in details in the following embodiments with reference to the accompanying drawings. However, the embodiments described are not intended to limit the invention. Moreover, it is not intended for the description of operation to limit the order of implementation. Any device with equivalent functions that is produced from a structure formed by a recombination of elements shall fall within the scope of the invention. Moreover, the drawings are only used for illustration and are not depicted to scale.

As used herein, "about", "approximately", or "roughly" typically refers that the error or range of the quantity is within 20%, preferably within 10%, and more preferably within 5%. If not expressly described herein, the quantities mentioned herein are all considered to be approximate values, i.e., the error or range indicated as "about", "approximately", or "roughly".

The following embodiment of the invention discloses a LED driving circuit. The LED driving circuit uses a PFM to change the light-emitting frequency of the LED, so as to achieve a function of color temperature modulation.

Figure 1:
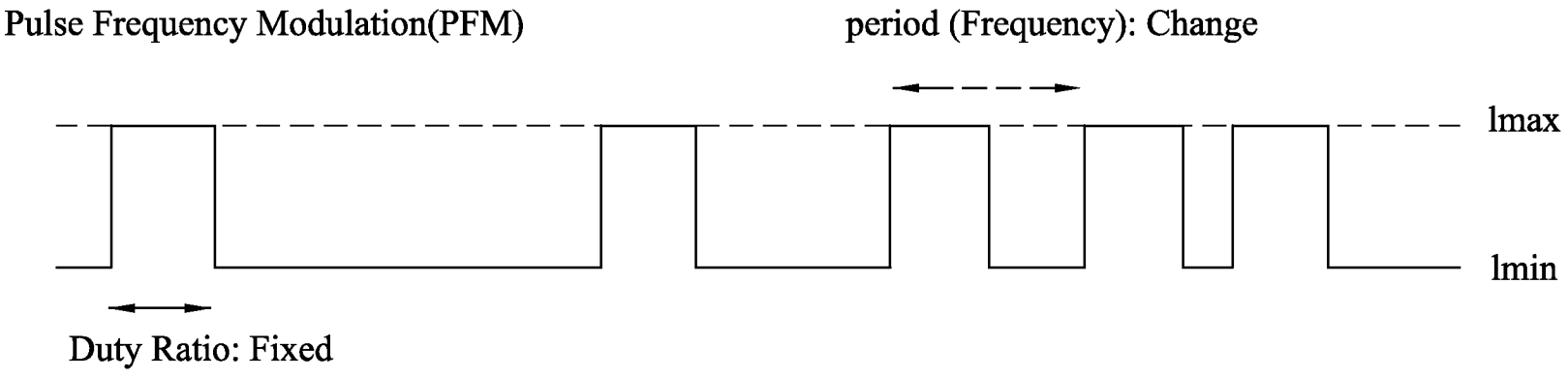
FIG. 1 is a schematic diagram of a PWM.

FIG. 1 is a schematic diagram of a PFM. It can be clearly seen from the diagram that, the PFM mode is primarily configured for modulating a frequency (or a period) of a plurality of pulses. Different from the PWM mode which changes a duty ratio of the pulse under a fixed pulse frequency, the PFM is primarily configured for changing the pulse frequency (or the period) under a fixed pulse duty ratio.

Figure 2:
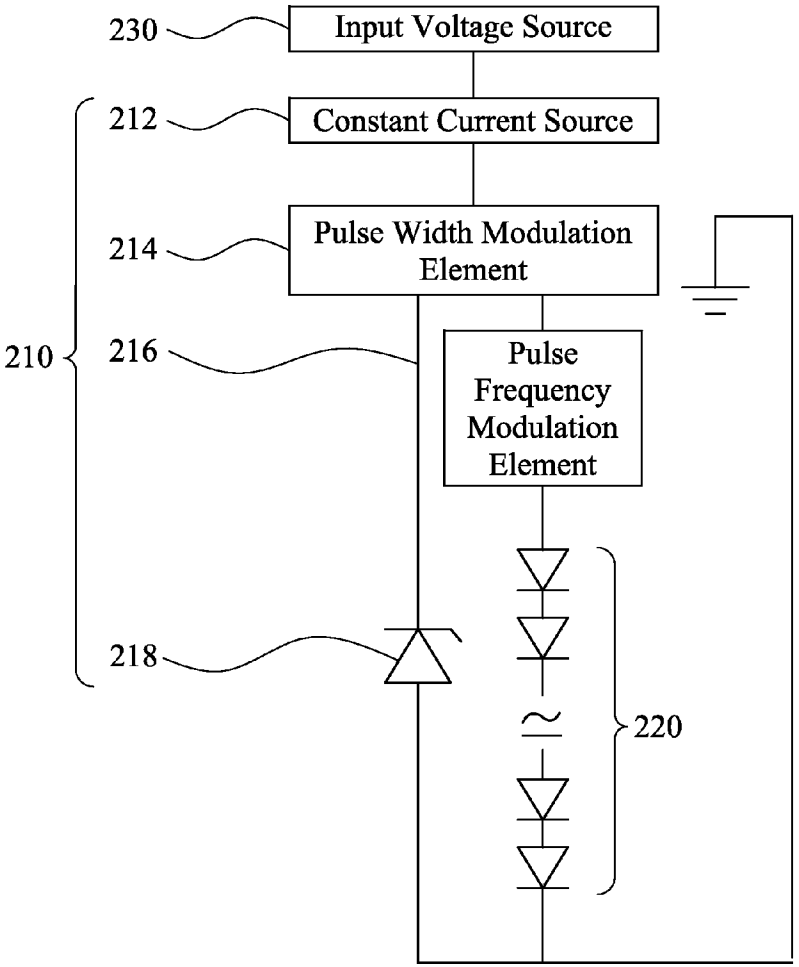
FIG. 2 is a schematic diagram of a LED driving circuit depicted according to an embodiment of the invention.

FIG. 2 is a schematic diagram of a LED driving circuit depicted according to an embodiment of the invention. As shown in FIG. 2, a LED driving circuit 210 is configured for driving at least one group of LEDs 220 and includes a constant current source 212, a PWM element 214, and at least one PFM element 216. The constant current source 212 is configured for generating a current signal with a constant current value; the PWM element 214 is electrically connected to the constant current source 212 to generate a PWM signal corresponding to the current signal; and at least one PFM element 216 is electrically connected between the PWM element 214 and at least one group of LEDs 220 and is configured for modulating a frequency width of the PWM signal to generate at least one PFM signal for driving at least one group of LEDs 220.

An input voltage source 230 provides an input voltage to the LED driving circuit 210, such that the current corresponding to the input voltage can be rectified by the constant current source 212 into the current signal with a constant current value. This current signal is then transmitted to the PWM element 214 and becomes a PWM signal with the fixed duty ratio after the pulse width thereof is modulated by the PWM element 214. Generally, the duty ratio of the PWM signal may be fixed in a range of 10% to 100% by the PWM element. The PWM signal includes a plurality of pulses, and the above-described pulses have the fixed duty ratio and are identical in width.

The PWM signal is then transmitted to the PFM element 216, such that the PWM signal is transformed into a PFM signal (for example, the PFM signal as shown in FIG. 1) after the pulse width thereof is modulated by the PFM element 216. The PFM signal includes a plurality of pulses, and at least two of the time intervals among the pulses with the same width are different, and that is, the frequency (or the period) of the PFM signal can be modulated.

The PFM element 216 modulates the PWM signal, and whereby a PFM signal with a modulatable frequency is outputted. The PFM signal is then used for driving the LED 220 electrically connected to the PFM element 216 to make the LED 220 emit light. In an embodiment, the frequency of the PFM signal for driving the LED 220 is modulated according to a visible light to be presented as desired.

Here, it should be noted that, when the PFM element 216 modulates the frequency width of the PWM signal, the PFM signal is changed, and the light-emitting frequency of the LED 220 is also changed. Due to the inertia of human eyes, light intensity perceived by the human eyes is changed as the light-emitting frequency of the light is changed, and thus color intensity of the LED 220 perceived by the human eyes is also changed as the light-emitting frequency of the light of the LED is changed.

Specifically, if only one group of LEDs 220 exists here, when the PFM element 216 modulates the frequency width of the PWM signal, the light-emitting frequencies of this group of LEDs 220 are also changed. Since the light-emitting intensity perceived by the human eyes for different light-emitting frequencies of the LEDs is different, at this time, the color intensity perceived by the human eyes is changed.

If plural groups of LEDs 220 exist here, then when the PFM element 216 performs different frequency width modulations for different PWM signals, the light-emitting frequencies of these groups of LEDs 220 are changed differently. At this time, the color seen by the human eyes is a result of mixing the lights with different light-emitting intensity generated by all the LEDs 220 under different light-emitting frequencies. Therefore, the color seen by the human eyes is changed to achieve color temperature modulation, which is described in more details in the following embodiments.

Moreover, in another embodiment, the LED driving circuit 210 may further include a voltage regulator circuit 218. The voltage regulator circuit 218 is connected in parallel with the LED 220 for stabilizing the LED driving circuit 210. In implementation, the voltage regulator circuit 218 may be embodied by using a voltage stabilizing diode.

Figure 3:
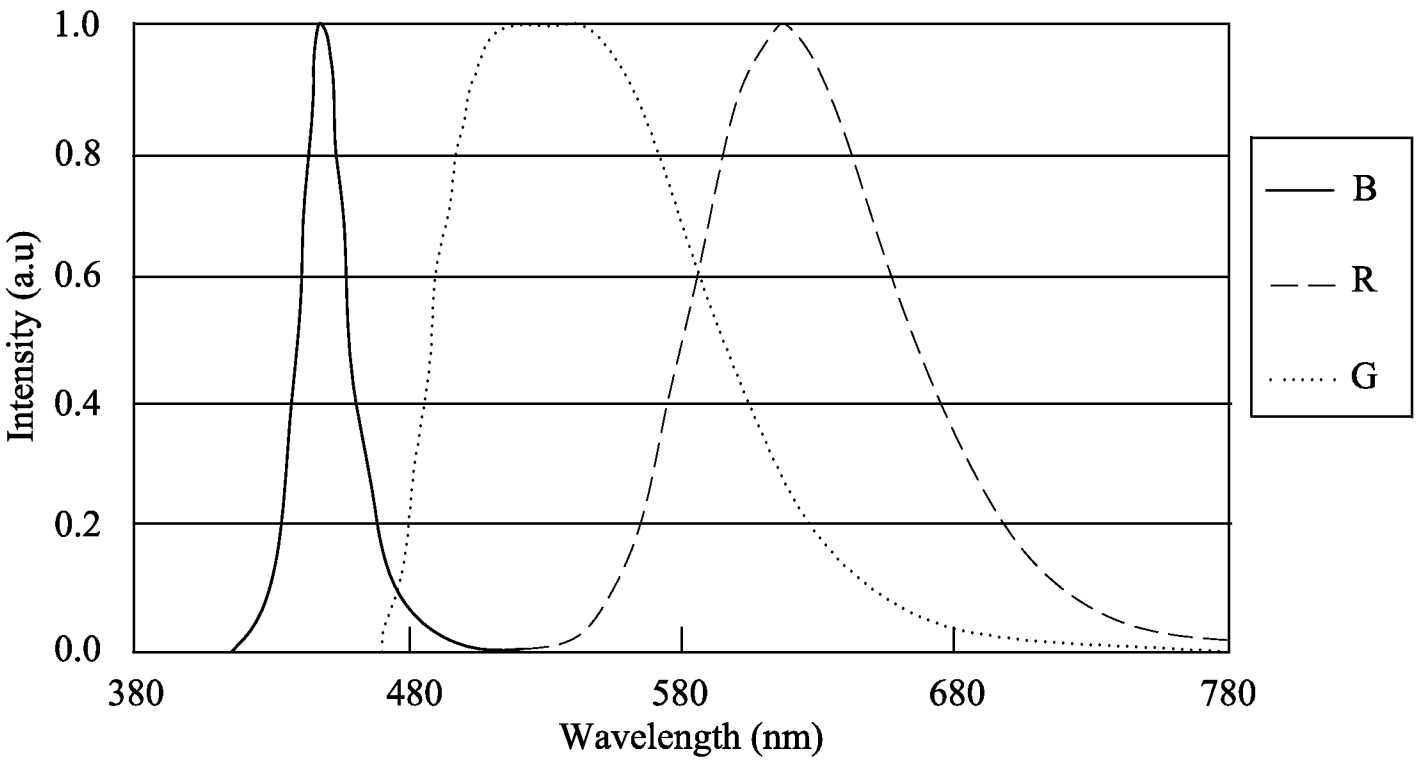
FIG. 3 is a schematic spectrum diagram of three primary colors that are red (R), green (G) and blue (B)

FIG. 3 is a schematic spectrum diagram of three primary colors that are red (R), green (G) and blue (B). Central wavelengths of the red, green and blue are each 630 nanometers (nm), 520 nm and 460 nm. The above-described PFM signals generated by the PFM element 216 in FIG. 2 can be used for driving three groups of LEDs each used for emitting red, green and blue lights.

Figure 4:
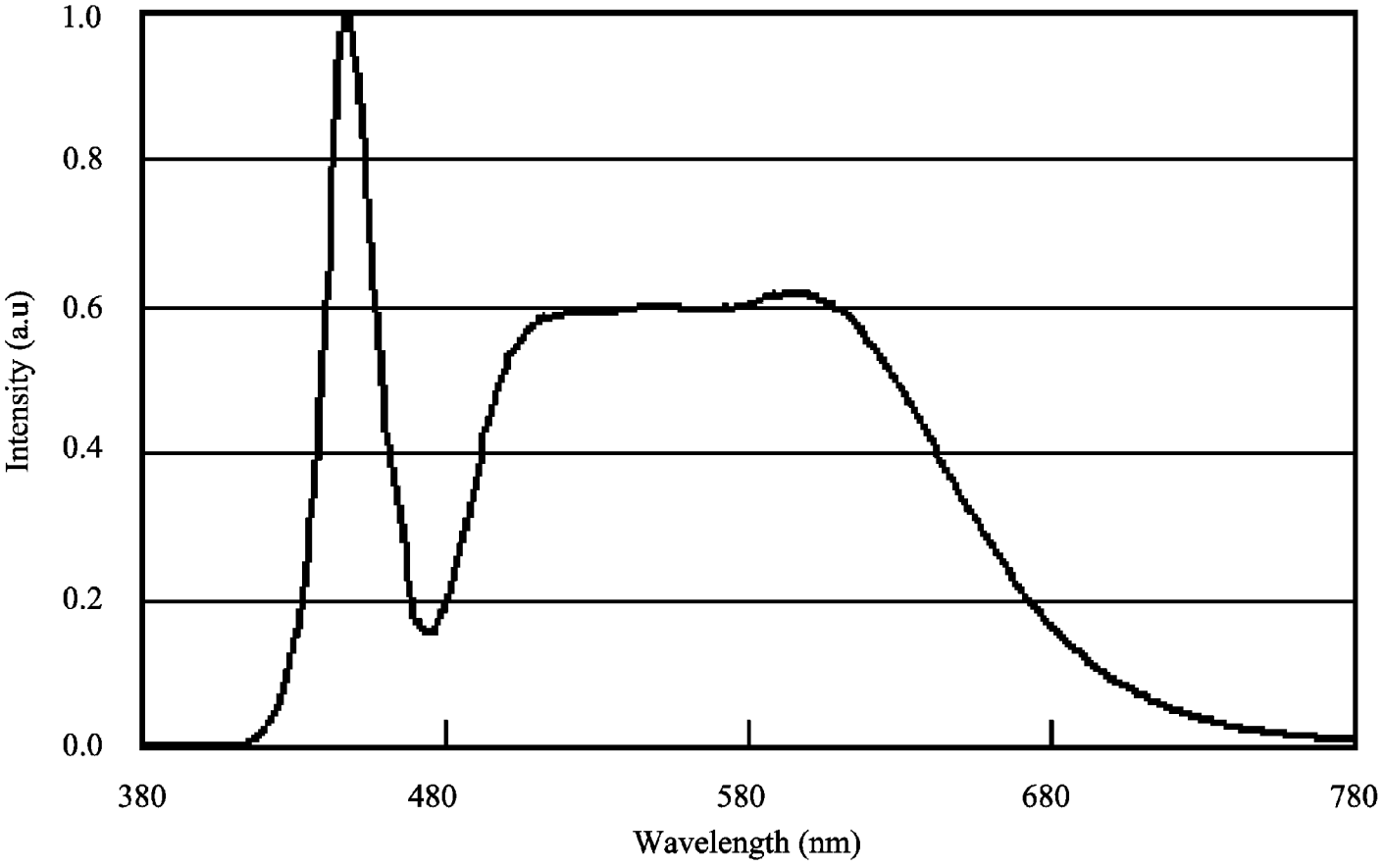
FIG. 4 is a schematic spectrum diagram depicted according to an embodiment of the invention.
Figure 5:
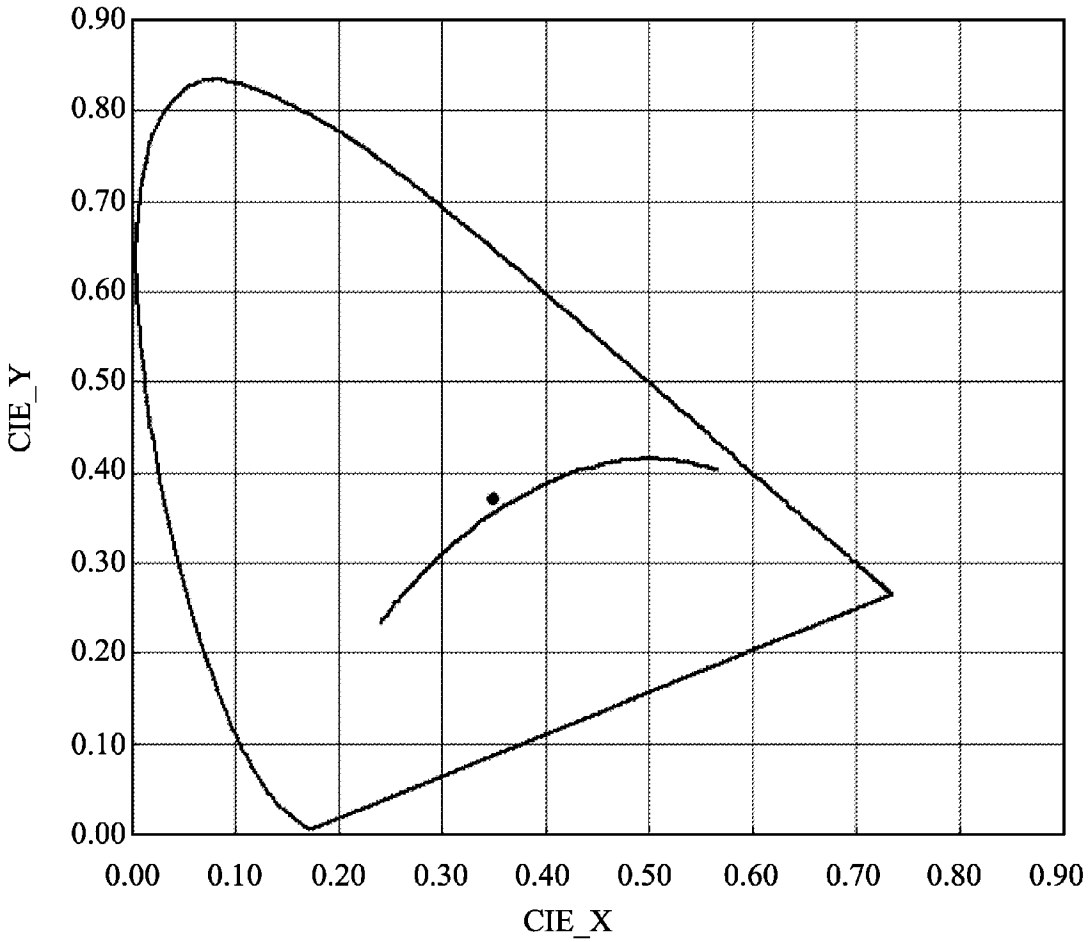
FIG. 5 is a CIE chromaticity diagram depicted according to an embodiment of the invention.

Referring to FIGS. 3-5 at the same time, in an embodiment, if the LED 220 (see FIG. 2) includes three groups of LEDs each used for emitting red, green and blue lights, and the frequencies of the PFM signals for driving the three groups of LEDs each used for emitting red, green and blue lights are each 4000 Hz, 4000 Hz, 100 Hz, then color intensity ratios of the red, green and blue lights perceived by the human eyes are each 20.5%, 29.4% and 50.1%, and thus a mixed white light is seen by the human eyes as a mixture of the red, green and blue lights according to the color intensity ratios, and the schematic spectrum diagram of this white light is shown as FIG. 4, in which at this time, the color temperature is 4,800 K. FIG. 5 is a CIE chromaticity diagram of the above-described embodiment. It can be seen from the diagram that, a coordinate of a CIE color dot is (0.350, 0.370), and at this time a mixed light color seen by the human eyes is pure white.

Figure 6:
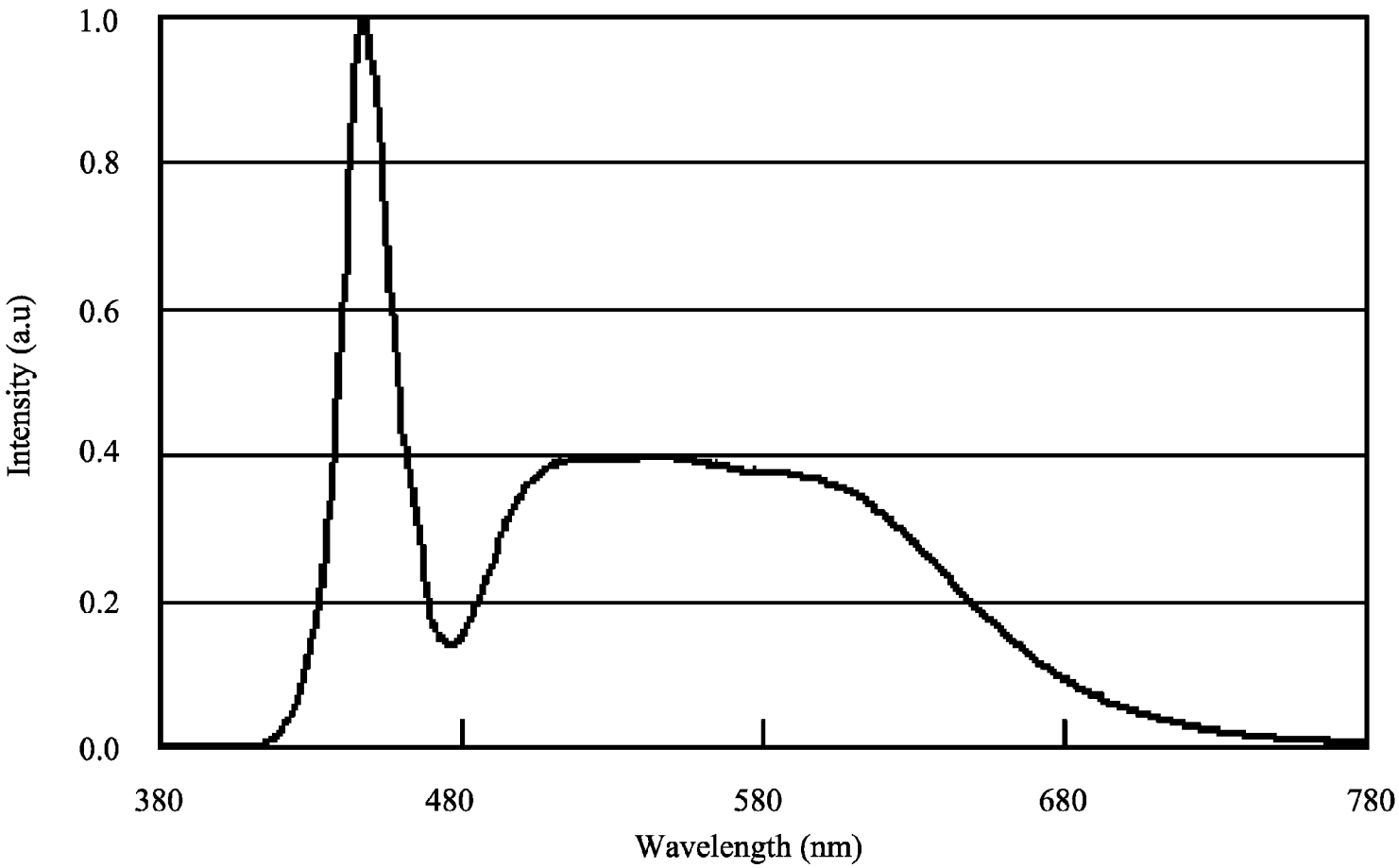
FIG. 6 is a schematic spectrum diagram depicted according to another embodiment of the invention.
Figure 7:
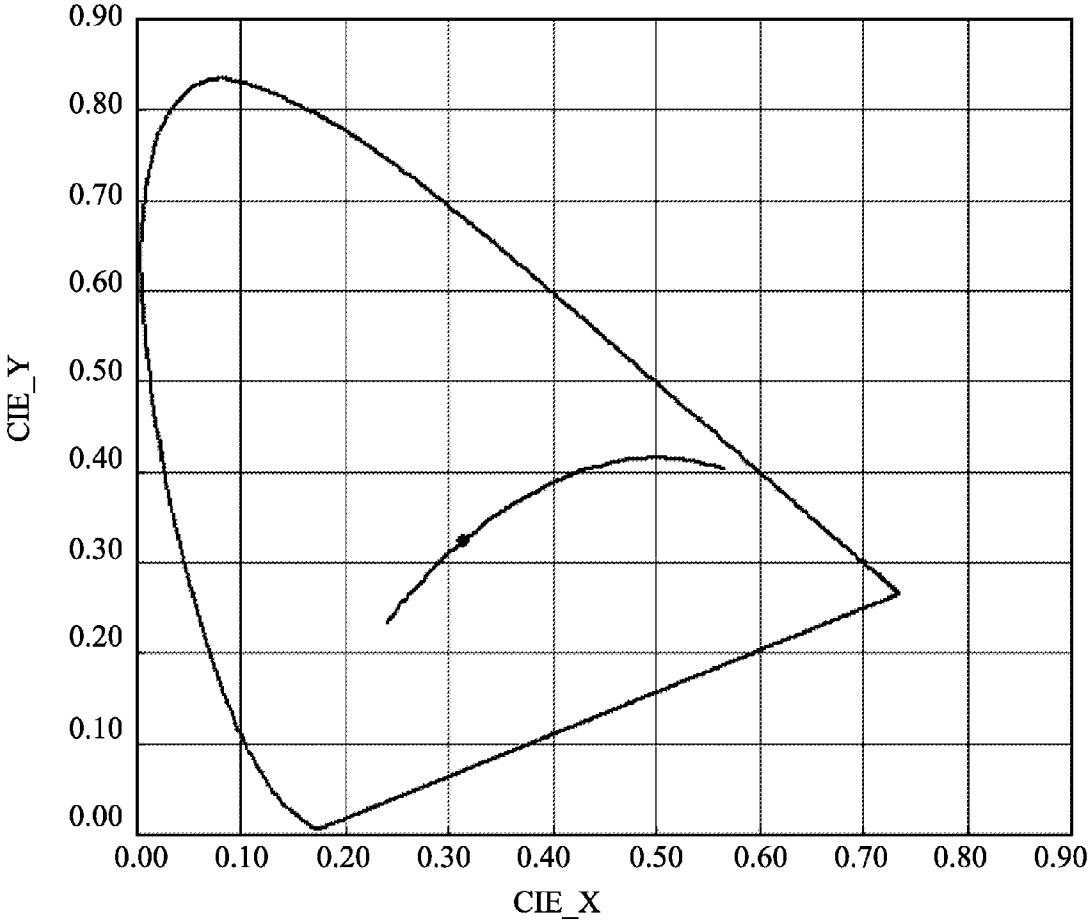
FIG. 7 is a CIE chromaticity diagram depicted according to another embodiment of the invention.

Referring to FIGS. 6 and 7 at the same time, in another embodiment, if the frequencies of the PFM signals for driving the LEDs 220 are changed such that the frequencies for driving the three groups of LEDs each used for emitting red, green and blue lights are each 100 Hz, 100 Hz and 4000 Hz, then the color intensity ratios of the red, green and blue lights perceived by the human eyes are each 13.7%, 24.2% and 62.0%. Similarly as the above embodiment, the mixed white light may be seen by the human eyes as a mixture of the red, green and blue lights according to the color intensity ratios, and the schematic spectrum diagram of this white light is shown as FIG. 6, in which at this time, the color temperature is 6,500 K. FIG. 7 is the CIE chromaticity diagram of the above-described embodiment. It can be seen from the diagram that, compared to FIG. 5, the coordinate of the CIE color dot is deviated to (0.313, 0.323), and at this time the mixed light color seen by the human eyes is cold white.

It can be seen from the above-described two embodiments that, intensity ratios of different colors seen by the human eyes are changed as the frequencies of the PFM signals for driving the LEDs are changed, and the color finally seen by the human eyes is a result of mixing the lights with different color intensity ratios. Therefore, the color seen by the human eyes is changed as the driving frequency of the PFM signal is changed. In other words, if the mixed light color is intended to be warm white or other colors, it can be achieved by adjusting the frequencies of the PFM signals for driving different LEDs.

It should be noted that, using the three groups of LEDs each used for emitting red, green and blue lights is only one of the embodiments of the invention, and not intended to limit the invention. Those of ordinary skills in the art may adjust the number of the groups and the colors of the LEDs as required without departing from the spirit of the invention.

Figure 8:
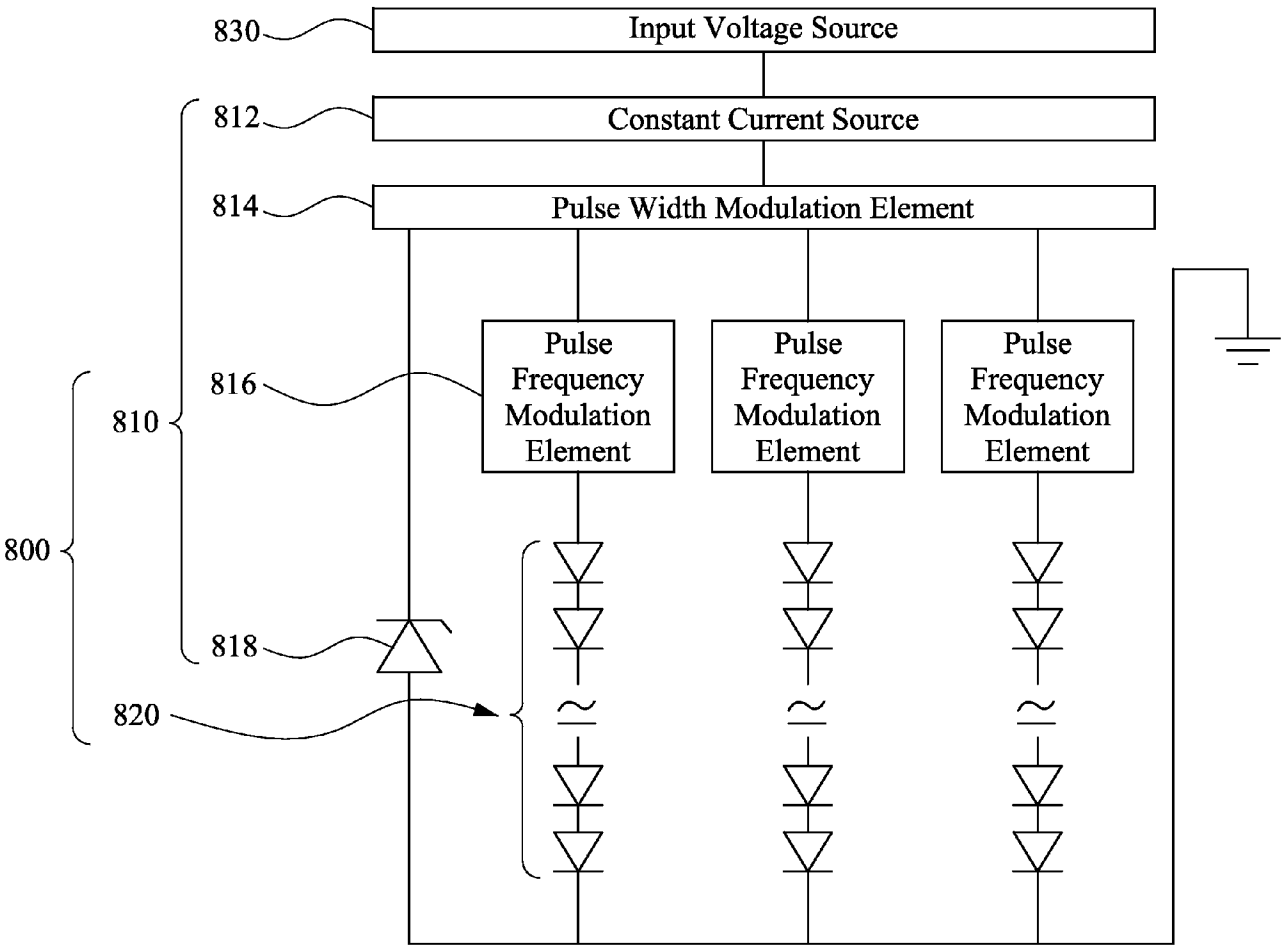
FIG. 8 is a schematic diagram of a light-emitting module circuit depicted according to an embodiment of the invention.

FIG. 8 is a schematic diagram of a light-emitting module circuit depicted according to an embodiment of the invention. The light-emitting module 800 includes plural groups of LEDs 820 that are connected in parallel with each other and a driving circuit 810. The driving circuit 810 includes a constant current source 812, a PWM element 814, and a plurality of PFM elements 816. The constant current source 812 is configured for generating a current signal with a constant current value; the PWM element 814 is electrically connected to the constant current source 812 and is configured for modulating the above-described current signal to generate a PWM signal corresponding to the current signal. The PFM elements 816 are each electrically connected between the LEDs 820 and the PWM element 814 and are configured for modulating the frequency width of the PWM signal to generate a plurality of PFM signals for driving each of the LEDs 820.

It can be seen from FIG. 8 that, an input voltage source 830 provides an input voltage to the light-emitting module 800, such that a current corresponding to the input voltage can be rectified by the constant current source 812 into a current signal with a constant current value. This current signal is then transmitted to the PWM element 814 and becomes a PWM signal with a fixed duty ratio after the pulse width thereof is modulated by the PWM element 814. Generally, the duty ratio of the PWM signal may be fixed in a range of 10% to 100% by the PWM element. The PWM signal includes a plurality of pulses, and the above-described pulses have the fixed duty ratio and are identical in width.

The PWM signal is then transmitted to the PFM element 816, such that the PWM signal is transformed into a plurality of PFM signals (for example, the PFM signals as shown in FIG. 1) after the PFM element 816 modulates the frequency width of the PWM signal. The PFM signal includes a plurality of pulses with the same width, and at least two of the time intervals among the pulses are different. The PFM signal then drives the LED 820 electrically connected to the PFM element 816 to make the LED 820 emit light.

When the PFM element 816 modulates the frequency width of the PWM signal, the above-described PFM signals are changed, and the light-emitting frequencies of the LEDs 820 are also changed. Since the light intensity perceived by the human eyes is changed as the light-emitting frequency of the light is changed, when the PFM element 816 performs different frequency width modulation for different PWM signals, the light-emitting frequencies of these LEDs 820 are changed differently.

At this time, the color seen by the human eyes is a result of mixing the light of different LEDs 820 under different light-emitting frequencies. Therefore, if the frequency of the PFM signal is adjusted according to different needs, the color of the light-emitting module 800 seen by the human eyes can be adjusted to change the color temperature.

Moreover, in another embodiment, the driving circuit 810 may further include a voltage regulator circuit 818, which is connected in parallel with the LED 820 for stabilizing the driving circuit 810. In implementation, the voltage regulator circuit 818 may be implemented by the voltage stabilizing diode.

Figure 9:
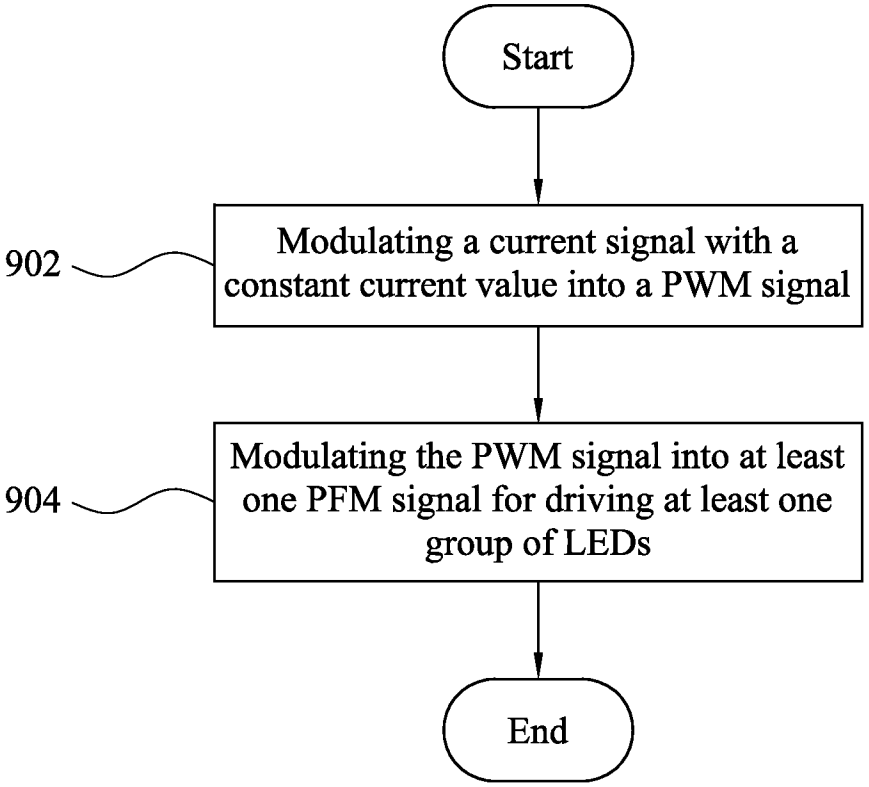
FIG. 9 is a flow chart of a method for driving the LED depicted according to an embodiment of the invention.

FIG. 9 is a flow chart of a method for driving the LED depicted according to an embodiment of the invention. Firstly, a current signal with a constant current value is modulated into a PWM signal (step 902), and then the PWM signal is modulated into at least one PFM signal for driving at least one group of LEDs (step 904).

In other embodiments, the above-described step 902 may further include modulating the current signal into a plurality of pulses as the PWM signal, in which these pulses are identical in width. Moreover, the above-described step 904 may further include modulating the time interval among the above-described pulses, such that at least two of the time intervals among the pulses are different.

When the time intervals among the pulses are modulated, the frequency of the above-described PFM signal is changed. When the frequency of the PFM signal for driving the LED is changed, the light-emitting frequency of the LED is changed, such that the light-emitting intensity perceived by the human eyes is also changed. Therefore, the light-emitting frequency of the LED can be changed by modulating the driving frequency of the PFM signal, so as to finally change the color temperature.

In view of the above, the PFM mode is used for changing the color temperature of the LED in the invention. Different from the PWM mode used in the conventional art, the PFM mode of the invention reduces the picture distortion or the color temperature imbalance that may be caused by the long-time use of the PWM mode. By utilizing the inertia of the human eyes, the PFM mode modulates the color temperature in the case that all the LEDs are maintained at the same light-emitting power, and thus no difference is generated in the brightness decay situation of different LEDs, so as to successfully avoid the color temperature imbalance.

Although the invention has been disclosed with reference to the above embodiments, these embodiments are not intended to limit the invention. It will be apparent to those of skills in the art that various modifications and variations can be made without departing from the spirit and scope of the invention. Therefore, the scope of the invention should be defined by the appended claims.

What is claimed is:

1. A light-emitting diode (LED) driving circuit configured for driving at least one group of LEDs, wherein the LED driving circuit comprises:

a constant current source configured for generating a current signal with a constant current value;

a pulse width modulation (PWM) element electrically connected to the constant current source and configured for modulating the current signal to generate a PWM signal corresponding to the current signal, wherein the PWM signal comprises a plurality of pulses identical in width; and at least one pulse frequency modulation (PFM) element electrically connected between the PWM element and the at least one group of LEDs and configured for modulating a frequency width of the PWM signal to generate at least one PFM signal for driving the at least one group of LEDs;

wherein when the at least one PFM element modulates the frequency width of the PWM signal, the at least one PFM signal is changed, and light-emitting frequencies of the at least one group of LEDs are also changed.

2. The LED driving circuit of claim 1, wherein the at least one PFM signal comprises a plurality of pulses identical in width, and at least two time intervals among the pulses are different.

3. The LED driving circuit of claim 1, further comprising:

a voltage regulator circuit connected in parallel with the at least one group of LEDs.

4. A light-emitting module, comprising:

plural groups of light-emitting diodes (LEDs), wherein these groups of LEDs are connected in parallel with each other; and a driving circuit configured for driving the groups of LEDs, wherein the driving circuit comprises:

a constant current source configured for generating a current signal with a constant current value;

a pulse width modulation (PWM) element electrically connected to the constant current source and configured for modulating the current signal to generate a PWM signal corresponding to the current signal; and a plurality of pulse frequency modulation (PFM) elements each electrically connected between the groups of LEDs and the PWM element and configured for modulating a frequency width of the PWM signal to generate a plurality of PFM signals for driving the groups of LEDs.

5. The light-emitting module of claim 4, wherein the PWM signal comprises a plurality of pulses identical in width.

6. The light-emitting module of claim 4, wherein each of the PFM signals comprises a plurality of pulses identical in width, and at least two time intervals among the pulses are different.

7. The light-emitting module of claim 4, wherein when the PFM elements modulate the frequency width of the PWM signal, the PFM signals are respectively changed, and light-emitting frequencies of the groups of LEDs are also changed respectively.

8. The light-emitting module of claim 4, further comprising:

a voltage regulator circuit connected in parallel with the groups of LEDs.

9. A method of driving a light-emitting diode (LED), comprising:

modulating a current signal with a constant current value into a pulse width modulation (PWM) signal; and modulating the PWM signal into at least one pulse frequency modulation (PFM) signal for driving at least one group of LEDs;

wherein the step of modulating the current signal into the PWM further comprises:

modulating the current signal into a plurality of pulses as the PWM signal, wherein these pulses are identical in width;

wherein when time intervals among the pulses are modulated, light-emitting frequencies of the at least one group of LEDs are changed.

10. The method for driving the LED of claim 9, wherein the step of modulating the PWM signal into the at least one PFM signal further comprises:

modulating the time intervals among the pulses such that at least two of the time intervals among the pulses are different.

* * * * *